US005367313A

United States Patent [19]

Orime et al.

[11] Patent Number: 5,367,313

[45] Date of Patent: Nov. 22, 1994

[54] ARRAY ANTENNA FOR RECEIVING RADIO COMMUNICATION

[75] Inventors: Nobutake Orime; Morio Higa; Yoshiyuki Chatani, all of Kamakura, Japan

[73] Assignee: Mitsubishi Denki Kabushiki Kaisha, Tokyo, Japan

[21] Appl. No.: 952,532

[22] PCT Filed: Apr. 6, 1992

[86] PCT No.: PCT/JP92/00422

§ 371 Date: Dec. 2, 1992

§ 102(e) Date: Dec. 2, 1992

[87] PCT Pub. No.: WO92/17916

PCT Pub. Date: Oct. 15, 1992

[30] Foreign Application Priority Data

Aug. 4, 1991 [JP] Japan ..... 3-075115

[51] Int. Cl.[5] ..... H01Q 21/00

[52] U.S. Cl. ..... 343/853; 343/754

[58] Field of Search ..... 343/853, 754, 778; 342/368, 372, 373, 374; H01Q 21/00, 21/24

[56] References Cited

U.S. PATENT DOCUMENTS 4,791,428 12/1988 Anderson ..... 343/853
4,965,605 10/1990 Chang et al. ..... 343/700 MS
5,038,151 8/1991 Kaminski ..... 343/853
5,218,368 6/1993 Huruno et al. ..... 343/700 MS

FOREIGN PATENT DOCUMENTS 0196705 8/1991 Japan ..... H01Q 21/24

OTHER PUBLICATIONS

H. Iwasaki, K. Yasukawa, K. Hidaka & T. Morooka, "Analysis of a Microstrip Active Array Antenna for DBS" Mar., 1987, National Convention Record-The Institute of Electronics, Information and Communication Engineers, Part 3.

*Primary Examiner*—Donald Hajec
*Assistant Examiner*—Tan Ho
*Attorney, Agent, or Firm*—Wolf, Greenfield & Sacks

[57] ABSTRACT

The present invention relates to an array antenna for receiving a signal in a microwave band. The array antenna includes a plurality radiating element arranged in subarrays, each subarray having a first feeder connected to the radiating elements and a low noise amplifier (LNA) connected to receive the output of the first feeder, a frequency converter, and a second feeder for combining the outputs of the sub arrays from the LNAs. According to this structure, in the formula representing the noise temperature observed at the radiating elements, the gain the LNA appears in the denominator in the term representing the loss of the second feeder which combines the outputs of the sub arrays. Therefore, if the gain of the LNA is sufficiently large, it is possible to disregard the influence of the loss of the first and second feeders for combining the outputs of the sub arrays on the noise temperature. If each sub array is composed of a plurality of radiating elements and a first feeder for combining the outputs of the radiating elements, the loss of the second feeder is reduced more as the number of sub arrays is increased. As a result, the gain over temperature (G/T) is enhanced. Since it is possible to set the optimum number of sub arrays, it is possible to realize the enhancement of the G/T at the minimum necessary cost.

18 Claims, 2 Drawing Sheets

ARRAY ANTENNA FOR RECEIVING RADIO COMMUNICATION

DESCRIPTION

1. Technical Field

The present invention relates to an array antenna for receiving a signal in a microwave band.

2. Background Art

FIG. 2 shows a conventional array antenna for receiving radio communication. In FIG. 2, the reference numeral 1 represents a radiating element, 2 a feeder for combining the radio waves which are received by the radiating elements 1, 3 a low noise amplifier (LNA) and 4 a frequency converter.

The operation of the conventional array antenna will now be explained. The radio waves received by a plurality of radiating elements 1 are combined by the feeder 2 and amplified by the LNA 3. Thereafter, the frequency of the combined radio wave signal is converted into a signal having predetermined frequency by the frequency converter 4, and the signal is supplied to a receiver (not shown).

The gain over temperature G/T, which is the most important index in a receiving antenna, is a value obtained by dividing the gain G of the antenna by the noise temperature T of the whole array antenna for receiving radio communication. In the structure shown in FIG. 2, the noise temperature T of the whole array antenna for receiving radio communication observed at the radiating elements 1 is obtained from the following formula (1):

$$T=T_a+(L-1)T_0+LT_e+LT_c/G_1 \quad (1)$$

wherein $T_a$: the noise temperature of the antenna

L : the loss of the feeder 2

$T_0$: environmental temperature $T_e$: the equivalent input noise temperature of the LNA 3

$T_c$: the equivalent input noise temperature of the frequency converter 4

$G_1$: the gain of the LNA 3

In the conventional array antenna for receiving radio communication having the above-described structure, it is possible to enhance the G/T by increasing the antenna directive gain G. In order to increase the antenna directly gain G, however, it is necessary to increase the number of radiating elements 1, which leads to the increase in the length of the wiring in the feeder 2 and, hence, to the increase in the loss L of the feeder 2. Since the increase in the loss L of the feeder 2 gradually deteriorates the G/T, there is a limit to the realizable G/T.

DISCLOSURE OF THE INVENTION

Accordingly, it is an object of the present invention to eliminate the above-described problems in the prior art and to provide an array antenna for receiving radio communication which has an enhanced G/T and which can be realized with the minimum necessary increase in cost.

To achieve this aim, in an array antenna for receiving communication according to the present invention, the antenna is divided into the minimum necessary number of sub arrays and an LNA is added to each sub array. By adding the LNA to each sub array, it is possible to reduce the influence of the loss of the feeder for combining the outputs of the sub arrays, thereby enhancing the G/T. Since it is possible to realize the desired G/T by the minimum necessary number of LNAs, the array antenna is realized at a low cost.

DETAILED DESCRIPTION

Figure 1:
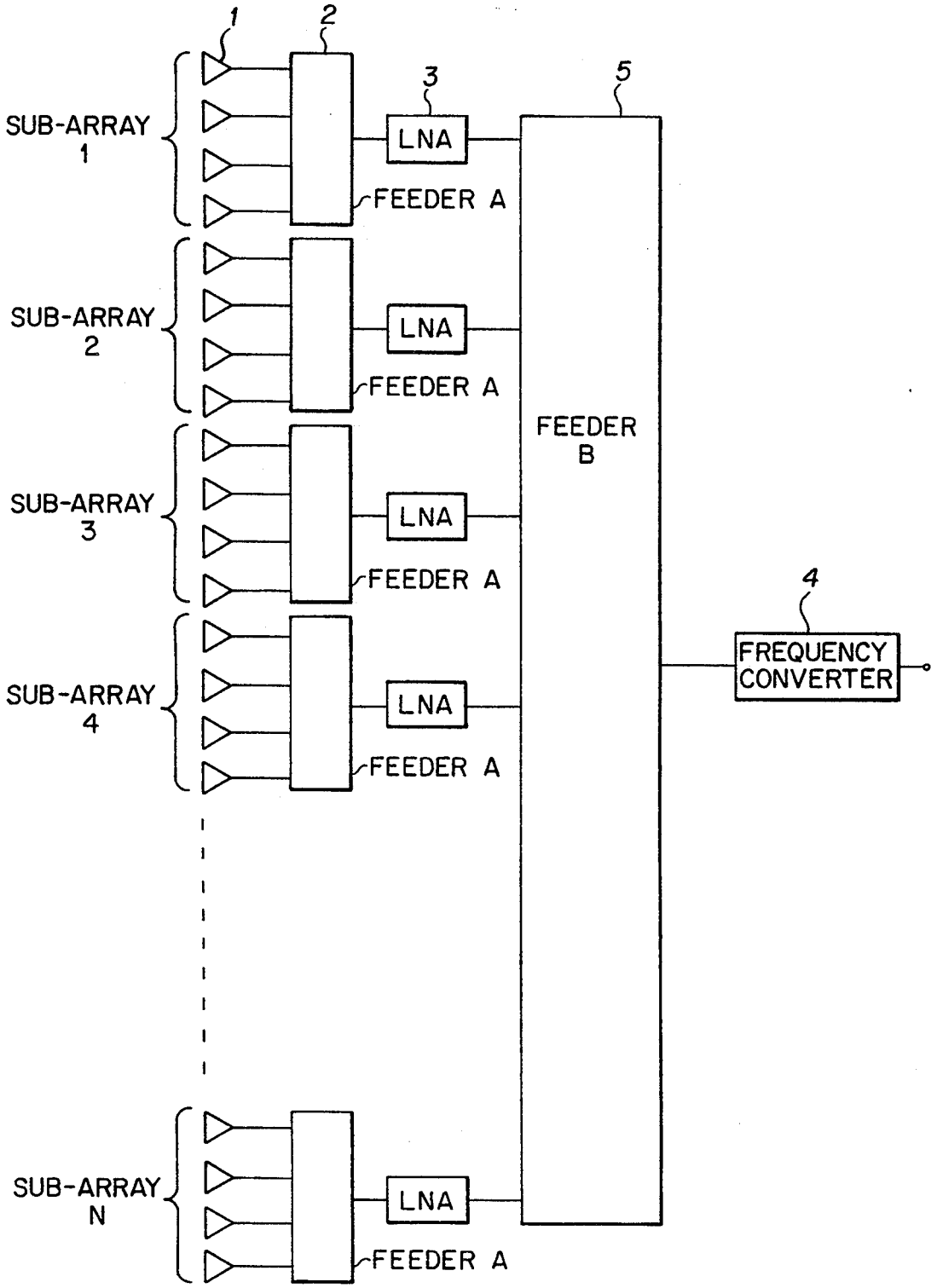
FIG. 1 is a block diagram of the structure of an embodiment of an array antenna for receiving radio communication according to the present invention.
Figure 2:
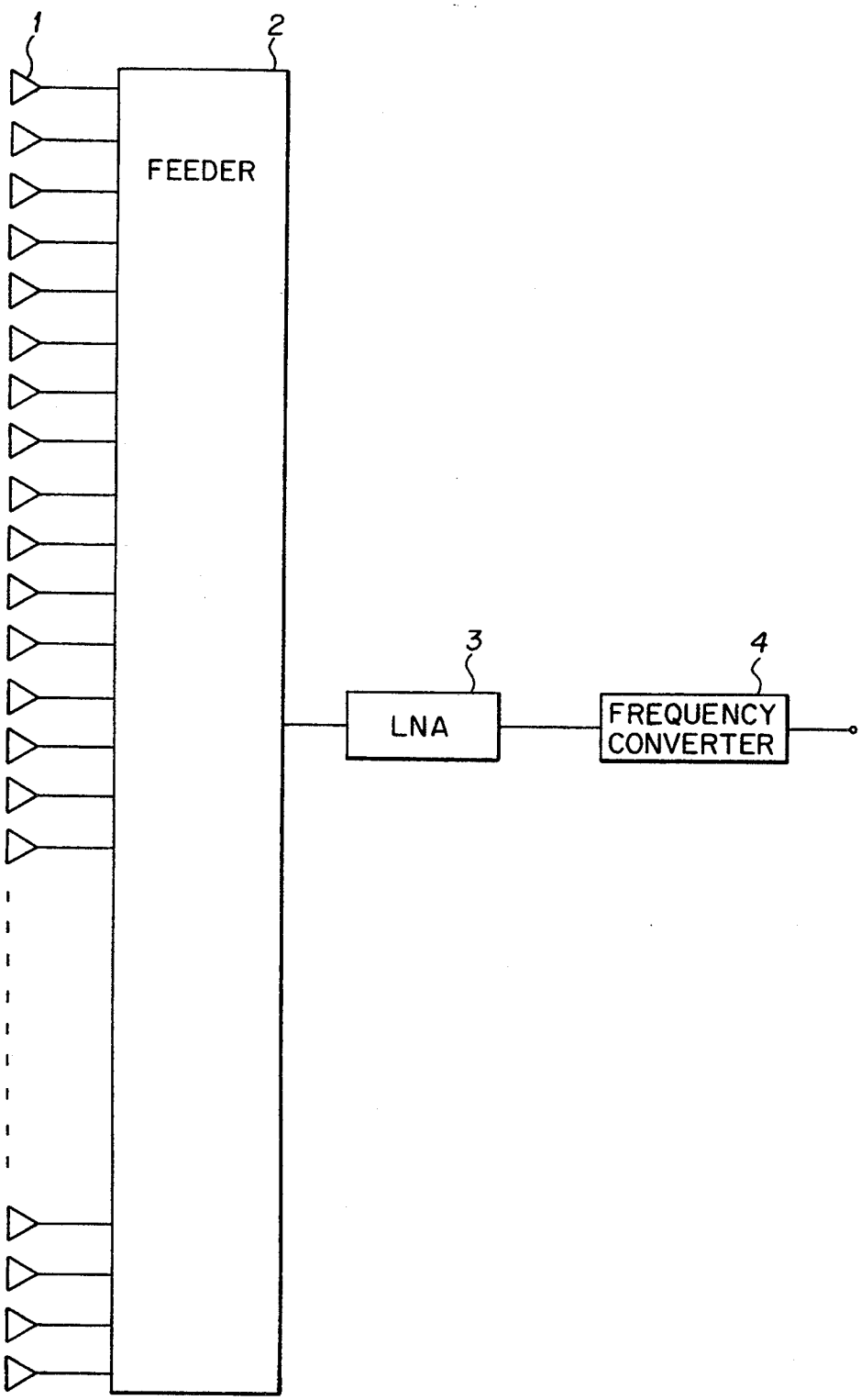
FIG. 2 is a block diagram of the structure of a conventional array antenna for receiving radio communication.

In FIG. 1, the reference numeral 1 represents a radiating element, 2 a feeder A in a sub array, 3 an LNA, 4 a frequency converter, 5 a feeder B provided outside of the sub array, and 6 the sub array.

BEST MODE FOR CARRYING OUT THE INVENTION

An embodiment of the present invention will be explained hereinunder with reference to FIG. 1.

First Embodiment

In FIG. 1, the reference numeral 1 represents a radiating element, 2 a feeder A in a sub array, 3 an LNA, 4 a frequency converter, and 5 a feeder B for combining the outputs of the sub arrays. This embodiment is characterized by the fact that a single array antenna is composed by N (n: plural number) sub arrays (sub array 1 to sub array N) and that the sub array is composed of a predetermined number of radiating elements 1, and the feeder A 2 and the LNA 3, which are connected in cascade to the radiating elements 1.

In the antenna having the structure shown in FIG. 1, the noise temperature T of the whole antenna observed at the radiating elements 1 is obtained from the following formula (2):

$$T=T_a+(L_a-1)T_0+L_2T_e+L_a((L_b-1)T_0+L_bT_c)/G_1 \quad (2)$$

wherein $T_a$: the noise temperature of the antenna $L_a$: the loss of the feeder A 2

$T_0$: environmental temperature $T_e$: the equivalent input noise temperature of the LNA 3

$L_b$: the loss of the feeder B 5

$T_c$: the equivalent input noise temperature of the frequency converter 4

$G_1$: the gain of the LNA 3

In other words, the noise temperature T is represented by the formula which is obtained by substituting $L_a$ into L and $(L_b-1)T_0+L_bT_c$ into $T_c$, respectively, in the formula (1).

The loss $L_a$ of the feeder A 2 and the loss $L_b$ of the feeder B 5 are represented by the following formulas (3):

$$L_a=kd(n/N^{\frac{1}{2}}-1)\quad L_b=kdn(1-1/N^{\frac{1}{2}}) \quad (3)$$

wherein k : the loss of the feeder A 2 or the feeder B 5 per unit length d: interval between the elements 1 n: the square root of the number of elements 1

Consequently, if the gain $G_1$ of the $LNA_3$ is sufficiently large, it is possible to approximately disregard the loss $L_b$ of the feeder B 5, so that the influence of the loss $L_b$ of the feeder B 5 on the G/T is reduced. With the increase in the number N of sub arrays, the length of the wiring in the feeder A 2 can be shortened, so that the loss $L_a$ of the feeder A 2 is reduced and, hence, the G/T is enhanced.

However, since the increase in the number of LNAs 3 leads to an increase in the cost, it is desirable that N is limited to the minimum necessary. It is therefore favorable to set the desired value C of G/T and design the antenna so that N is the minimum while the G/T satisfies the following relationship (4):

$$G/T \geqq C \quad (4)$$

As described above, according to the present invention, since the antenna is divided into sub arrays and an LNA is added to each sub array, the loss of the feeder at the subsequent stage of the LNA is unlikely to increase the G/T. In addition, with the increase in the number of sub arrays, the loss of the feeder within the sub array is reduced, so that the G/T is enhanced. By appropriately selecting the number of LNAs, it is possible to reduce the number of LNAs while obtaining the necessary G/T, which leads to a reduction in cost.

We claim:

1. An array antenna for receiving radio communication, and having a gain over temperature index G/T, comprising:

(a) a number of subarrays, each of said subarrays including:

(i) a plurality of radiating elements each having a noise temperature Ta;

(ii) a first feeder, having a loss La, for combining the outputs of said plurality of radiating elements and providing a combined output; and (iii) a low noise amplifier having a gain Gl, an equivalent input noise temperature Te and an input connected to the combined output of the first feeder for amplifying the combined output of said first feeder and providing an amplified output as an output of the subarray;

(b) a second feeder having a loss Lb and inputs connected to the amplified outputs of the low noise amplifiers for combining the outputs of said subarrays and outputting the combined output, and (c) a frequency converter connected to the output of the second feeder for converting the frequency of the output of said second feeder and having an equivalent noise temperature Tc, wherein the gain of the low noise amplifier is such that an influence of the loss of the second feeder on the gain over temperature index G/T of the antenna is reduced and wherein at an environmental temperature To, a noise temperature T of the antenna is Ta+(La−1)To+LaTe+La((Lb−1)To+LbTc)/Gl, and an overall gain G of the antenna is such that G/T is greater than a predetermined threshold.

2. An array antenna for receiving radio communication, according to claim 1, wherein the number of subarrays is maximized without letting the loss of the first feeders affect the gain over temperature index of the antenna.

3. An array antenna for receiving radio communication, according to claim 2, wherein the number of said subarrays is the minimum such that gain over temperature index of the antenna array is not less than a desired value.

4. An array antenna for receiving radio communication, having a gain over temperature index G/T, comprising:

(a) a number of sub arrays, each of said sub arrays including:

(i) a plurality of radiating elements each having a noise temperature Ta;

(ii) a first feeder, having a loss La, for combining the outputs of said plurality of radiating elements and providing a combined output; and (iii) a low noise amplifier having a gain Gl, an equivalent input noise temperature Te and an input connected to the combined output of the first feeder for amplifying the combined output of said first feeder and providing an amplified output as an output of the subarray;

(b) a second feeder having a loss Lb and inputs connected to the amplified outputs of the low noise amplifiers for combining the outputs of said sub arrays and outputting the combined output, and (c) a frequency converter connected to the output of the second feeder for converting the frequency of the output of said second feeder and having an equivalent noise temperature Tc, wherein, at an environmental temperature To, a noise temperature T of the antenna is Ta+(La−1)To+LaTe+La((Lb−1)To+LbTc)/Gl, and an overall gain G of the antenna is such that, the number of said subarrays is the minimum such that the gain over temperature index G/T of the antenna array is not less than a desired value.

5. An array antenna for receiving radio communication, having a gain over temperature index G/T, comprising:

a feeder having a loss Lb and a plurality of inputs and an output which provides a signal which is a combination of the inputs;

a frequency converter connected to the output of the second feeder for converting the frequency of the output of said second feeder and having an equivalent noise temperature Tc, a plurality of low noise amplifiers, each having a gain Gl, an equivalent input noise temperature Te and an input and an output connected to an input of the feeder;

each low noise amplifier having a corresponding subarray feeder having a loss La, a number of inputs and an output, connected to the input of the low noise amplifiers, which provides a signal which is a combination of the inputs; and each of the plurality of inputs of the plurality of subarray feeders having a corresponding radiating element having a noise temperature Ta for receiving radiowaves connected thereto, wherein the gain Gl of the low noise amplifier is set so that an influence of the loss of the feeder on the gain over temperature index G/T of the antenna is reduced and wherein at an environmental temperature To, a noise temperature T of the antenna is Ta+(La−1)To+LaTe+La((Lb−1)To+LbTc)/Gl, and an overall gain G of the antenna is such that G/T is greater than a predetermined threshold.

6. An array antenna for receiving radio communication according to claim 5, wherein the number of said sub arrays is the minimum such that the gain over temperature of the antenna array is not less than a desired value.

7. The array antenna of claim 5, wherein the number of inputs of subarray feeders is maximized such that an influence of the gain of the feeder on the gain over temperature index of the antenna is reduced.

8. An array antenna for receiving radio communication according to claim 7 wherein the number of said subarrays is the minimum such that the gain over temperature index of the antenna array is not less than a desired value.

9. An array antenna for receiving radio communication, having a gain over temperature index G/T, comprising:

a feeder having a loss Lb, a plurality of inputs and an output which provides a signal which is a combination of the inputs;

a frequency converter connected to the output of the second feeder for converting the frequency of the output of said second feeder and having an equivalent noise temperature Tc, a number of low noise amplifiers, each having a gain Gl, an equivalent input noise temperature Te, an input and an output connected to an input of the feeder;

each low noise amplifier having a corresponding subarray feeder having a loss La, a plurality of inputs and an output, connected to the input of the low noise amplifiers, which provides a signal which is a combination of the inputs; and each of the plurality inputs of the plurality of subarray feeders having a corresponding radiating element each having a noise temperature Ta for receiving radiowaves connected thereto, and wherein, at an environmental temperature To, a noise temperature T of the antenna is $Ta+(La-1)To+LaTe+La((Lb-1)To+LbTc)/Gl$, and an overall gain G of the antenna is such that, the number of said subarrays is the minimum such that the gain over temperature index G/T of the antenna array is not less than a desired value.

10. An array antenna for receiving radio communication comprising:

(a) a number of subarrays, each of said subarrays including:

(i) a plurality of radiating elements each having a noise temperature Ta;

(ii) a first feeder having a loss La and for combining the outputs of said plurality of radiating elements and providing a combined output; and (iii) a low noise amplifier having a gain Gl, an equivalent input noise temperature Te and an input connected to the combined output of the first feeder for amplifying the combined output of said first feeder and providing an amplified output as an output of the subarray; and (b) a second feeder having a loss Lb and inputs connected to the amplified outputs of the low noise amplifiers for combining the outputs of said subarrays and outputting the combined output, (c) a frequency converter connected to the output of the second feeder for converting the frequency of the output of said second feeder and having an equivalent noise temperature Tc, wherein at an environmental temperature To, a noise temperature T of the antenna is $Ta+(La-1)To+LaTe+La((Lb-1)To+LbTc)/Gl$, and an overall gain G of the antenna is such that the number of subarrays is the minimum possible to provide a ratio of the gain to the noise temperature, which ratio is greater than a predetermined desired ratio.

11. An array antenna for receiving radio communication, having a gain over temperature index G/T, comprising:

(a) a number of subarrays, each of said subarrays including:

(i) a plurality of radiating elements each having a noise temperature Ta;

(ii) a first feeder, having a loss La, for combining the outputs of said a plurality of radiating elements and providing a combined output; and (iii) a low noise amplifier having a gain Gl, an equivalent input noise temperature Te and an input connected to the combined output of the first feeder for amplifying the combined output of said first feeder and providing an amplified output as an output of the subarray; and (b) a second feeder having a loss Lb and inputs connected to the amplified outputs of the low noise amplifiers for combining the outputs of said subarrays and outputting the combined output, (c) a frequency converter connected to the output of the second feeder for converting the frequency of the output of said second feeder and having an equivalent noise temperature Tc, wherein the number of subarrays is maximized such that an influence of the loss of the first feeders on the gain over temperature index of the antenna is reduced and wherein at an environmental temperature To, a noise temperature T of the antenna is $Ta+(La-1)To+LaTe+La((Lb-1)To+LbTc)/Gl$, and an overall gain G of the antenna is such that G/T is greater than a predetermined threshold.

12. An array antenna for receiving radio communication according to claim 11, further comprising a frequency converter for converting the frequency of the output of said first feeder.

13. An array antenna for receiving radio communication according to claim 11, wherein the number of said subarrays is the minimum such that the gain over temperature index of the antenna array is not less than a desired value.

14. An array antenna for receiving radio communication, having a gain over temperature index G/T, comprising:

a feeder having a loss Lb, a plurality of inputs and an output which provides a signal which is a combination of the inputs;

a frequency converter connected to the output of the second feeder for converting the frequency of the output of said second feeder and having an equivalent noise temperature Tc, a plurality of low noise amplifiers, each having a gain Gl, an equivalent input noise temperature Te and an input and an output connected to an input of the feeder;

each low noise amplifier having a corresponding subarray feeder having a loss La, a number of inputs and an output, connected to the input of the low noise amplifiers, which provides a signal which is a combination of the inputs; and each of the plurality of inputs of the plurality of subarray feeders having a corresponding radiating element having a noise temperature Ta for receiving radiowaves connected thereto, wherein the gain of the low noise amplifier is set and the number of inputs of the subarray feeders is maximized such that an influence of the loss of the subarray feeders on the gain over temperature index of the antenna is reduced, and wherein at an environmental temperature To, a noise temperature T of the antenna is $Ta+(La-1)To+LaTe+La((Lb-1-$ )To+LbTc)/Gl, and an overall gain G of the antenna is such that G/T is greater than a predetermined threshold.

15. An array antenna for receiving radio communication according to claim 14, further comprising a frequency converter connected to the output of the feeder for converting the frequency of the output of said feeder.

16. An array antenna for receiving radio communication according to claim 14, wherein the number of said subarrays is the minimum such that the gain over temperature index of the antenna array is not less than a desired value.

17. A method for constructing an array antenna for receiving radio communication having a gain over noise temperature index, the method comprising the steps of:

selecting a plurality of radiating elements, each having an output;

selecting a number of first feeders, each having a loss, a plurality of inputs and an output;

connecting the output of each radiating element to a selected input of a selected first feeder;

selecting a number of low noise amplifier, each having a gain and an input connected to the output of a selected one of the first feeders; and selecting a second feeder having a loss, inputs connected to the outputs of the low noise amplifiers and an output;

setting the gain of the low noise amplifier so that any effect of the loss of the second feeder on the gain over temperature index of the antenna is counteracted; and setting the number of first feeders to a maximum number without letting the loss of the first feeder affect the gain over temperature index of the antenna, wherein the determining the noise temperature T of the antenna array using the formula $$T=T_a+(L_a-1)T_0+L_aT_e+L_a((L_b-1)T_0+L_bT_c)/G_1$$

where Ta is the noise temperature of the radiating elements connected to each first feeder, La is the loss of each first feeder, $T_0$ is an environmental temperature, $T_e$ is an equivalent input noise temperature of the low noise amplifier, $L_b$ is the loss of the second feeder, $T_c$ is an equivalent input noise temperature of the frequency converter and $G_1$ is the gain of the low noise amplifier; and selecting a desired gain over temperature index C and constructing the antenna with a gain G such that $G/T \geqq C$.

18. The method of claim 17 wherein the step of determining the noise temperature comprises the steps of:

determining the loss La of the first feeder using the formula $L_a=kd(n/N^{\frac{1}{2}}-1)$; and determining the loss of Lb of the second feeder using the formula $L_b=kdn(1-1/N^{\frac{1}{2}})$;

where k is the loss of the first feeder and the second feeder per unit length, wherein d is a spacing between the radiating elements and n is the square root of the number of radiating elements.

* * * * *